US010988834B2

(12) United States Patent
Lee et al.

(10) Patent No.: US 10,988,834 B2
(45) Date of Patent: Apr. 27, 2021

(54) CR—FE—MN—NI—V-BASED HIGH-ENTROPY ALLOY

(71) Applicants: POSTECH ACADEMY-INDUSTRY FOUNDATION, Pohang-si (KR); The Industry & Academic Cooperation in Chungnam National University, Daejeon (KR)

(72) Inventors: Byeong-joo Lee, Pohang-si (KR); Sung-hak Lee, Pohang-si (KR); Hyoung-seop Kim, Pohang-si (KR); Young-sang Na, Changwon-si (KR); Sun-ig Hong, Daejeon (KR); Won-mi Choi, Pohang-si (KR); Chang-woo Jeon, Suwon-si (KR); Seung-mun Jung, Yangsan-si (KR)

(73) Assignees: POSTECH ACADEMY-INDUSTRY FOUNDATION, Pohang-si (KR); THE INDUSTRY & ACADEMIC COOPERATION IN CHUNGNAM NATIONAL UNIVERSITY, Daejeon (KR)

( * ) Notice: Subject to any disclaimer, the term of this patent is extended or adjusted under 35 U.S.C. 154(b) by 194 days.

(21) Appl. No.: 16/084,610

(22) PCT Filed: Mar. 21, 2017

(86) PCT No.: PCT/KR2017/002989
§ 371 (c)(1),
(2) Date: Sep. 13, 2018

(87) PCT Pub. No.: WO2017/164602
PCT Pub. Date: Sep. 28, 2017

(65) Prior Publication Data

US 2019/0055630 A1 Feb. 21, 2019

(30) Foreign Application Priority Data

Mar. 21, 2016 (KR) ..... 10-2016-0033419
Mar. 15, 2017 (KR) ..... 10-2017-0032630

(51) Int. Cl.

| | |
|---|---|
| ***C22C 30/00*** | (2006.01) |
| ***C22C 19/05*** | (2006.01) |
| ***C22C 38/46*** | (2006.01) |
| ***C22C 38/58*** | (2006.01) |
| ***C22C 1/02*** | (2006.01) |

(52) U.S. Cl.
CPC ..... *C22C 30/00* (2013.01); *C22C 1/02* (2013.01); *C22C 19/05* (2013.01); *C22C 38/46* (2013.01); *C22C 38/58* (2013.01)

(58) Field of Classification Search
CPC ..... C22C 30/00; C22C 19/05; C22C 19/058; C22C 38/46; C22C 38/58; C22C 1/02; C22C 1/023; C22C 19/00
See application file for complete search history.

(56) References Cited

U.S. PATENT DOCUMENTS

| | | | | |
|---|---|---|---|---|
| 1,803,467 | A * | 5/1931 | Driver | C22C 19/00 420/48 |
| 2008/0031769 | A1* | 2/2008 | Yeh | C22C 1/03 420/580 |
| 2010/0133096 | A1* | 6/2010 | Hansen | C22C 38/42 204/242 |
| 2016/0025386 | A1 | 1/2016 | Barabash et al. | |
| 2017/0209954 | A1* | 7/2017 | Kato | C22C 30/00 |

FOREIGN PATENT DOCUMENTS

| | | | | |
|---|---|---|---|---|
| CN | 102787267 | A * | 11/2012 | |
| JP | 2002-173732 | | 6/2002 | |
| JP | 2010070814 | A * | 4/2010 | |
| JP | 2016-023352 | | 2/2016 | |
| KR | 10-2009-0030198 | | 3/2009 | |
| KR | 10-2016-0014130 | | 2/2016 | |
| WO | WO-2016013498 | A1 * | 1/2016 | B33Y 70/00 |

OTHER PUBLICATIONS

Stepanov; N.D., et al. "Effect of V content on microstructure and mechanical properties of the CoCrFeMnNiVx high entropy alloys," Jan. 8, 2015, Journal of Alloys and Compounds vol. 628, p. 170-185 (Year: 2015).*

* cited by examiner

*Primary Examiner* — Anthony J Zimmer
*Assistant Examiner* — Dean Mazzola
(74) *Attorney, Agent, or Firm* — Lex IP Meister, PLLC

(57) ABSTRACT

The present invention relates to a high-entropy alloy especially having excellent low-temperature tensile strength and elongation by means of having configured, through thermodynamic calculations, an alloy composition region having an FCC single-phase microstructure at 700° C. or higher, and enabling the FCC single-phase microstructure at room temperature and at an ultra-low temperature. The high-entropy alloy, according to the present invention, comprises: Cr: 3-18 at %; Fe: 3-60 at %; Mn: 3-40 at% ; Ni: 20-80 at %: 3-12 at %; and unavoidable impurities, wherein the ratio of the V content to the Ni content (V/Ni) is 0.5 or less.

5 Claims, 22 Drawing Sheets

【FIG.1】
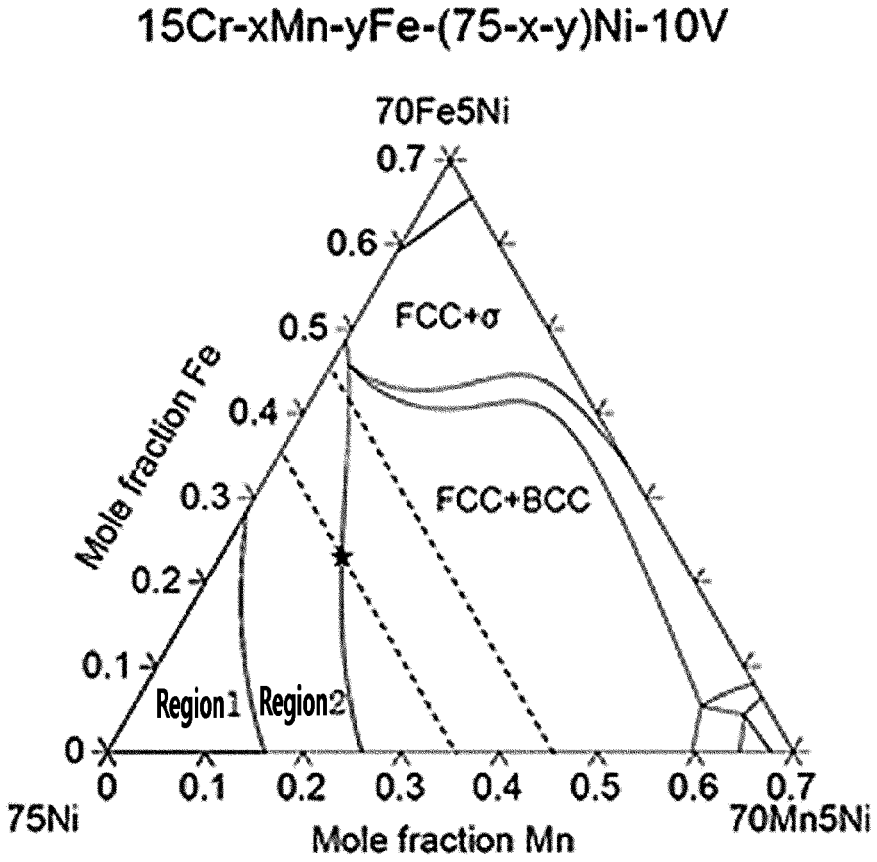

[FIG.2]
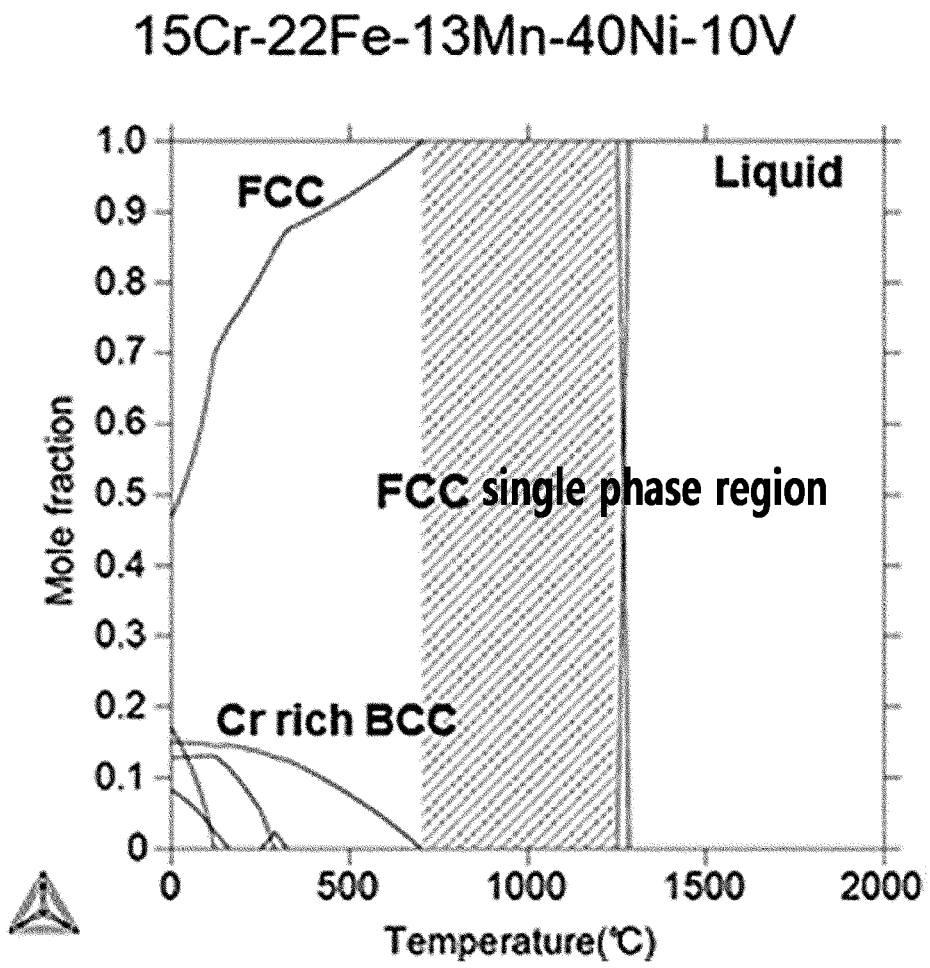

[FIG.3]
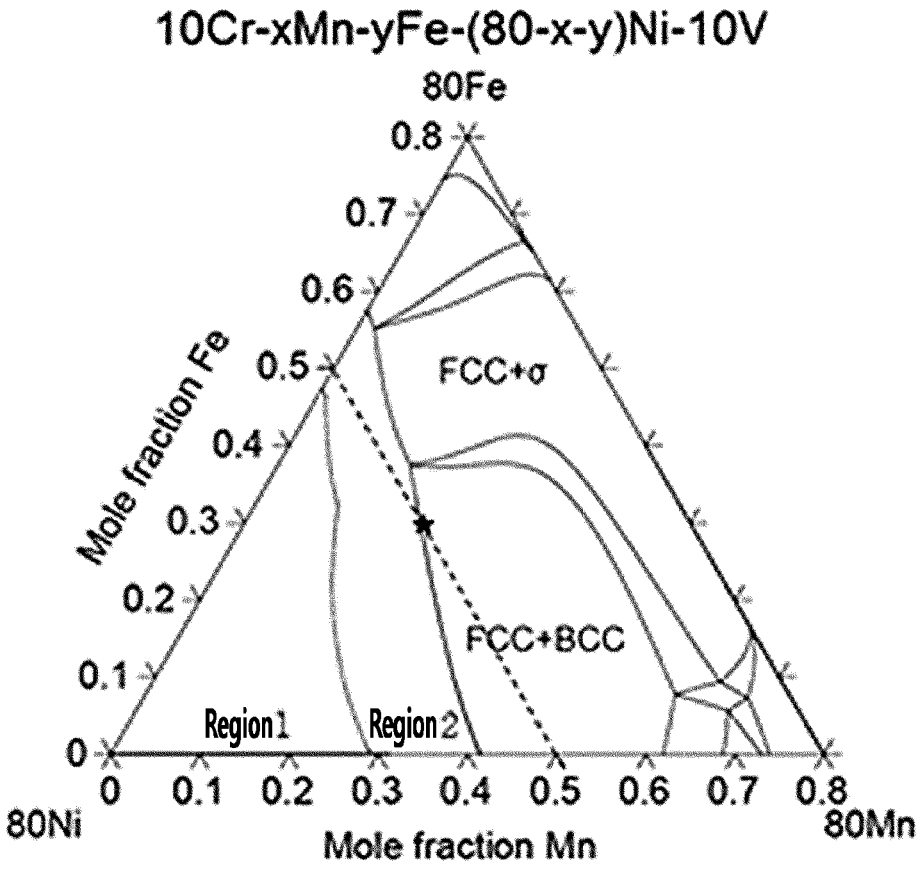

[FIG.4]
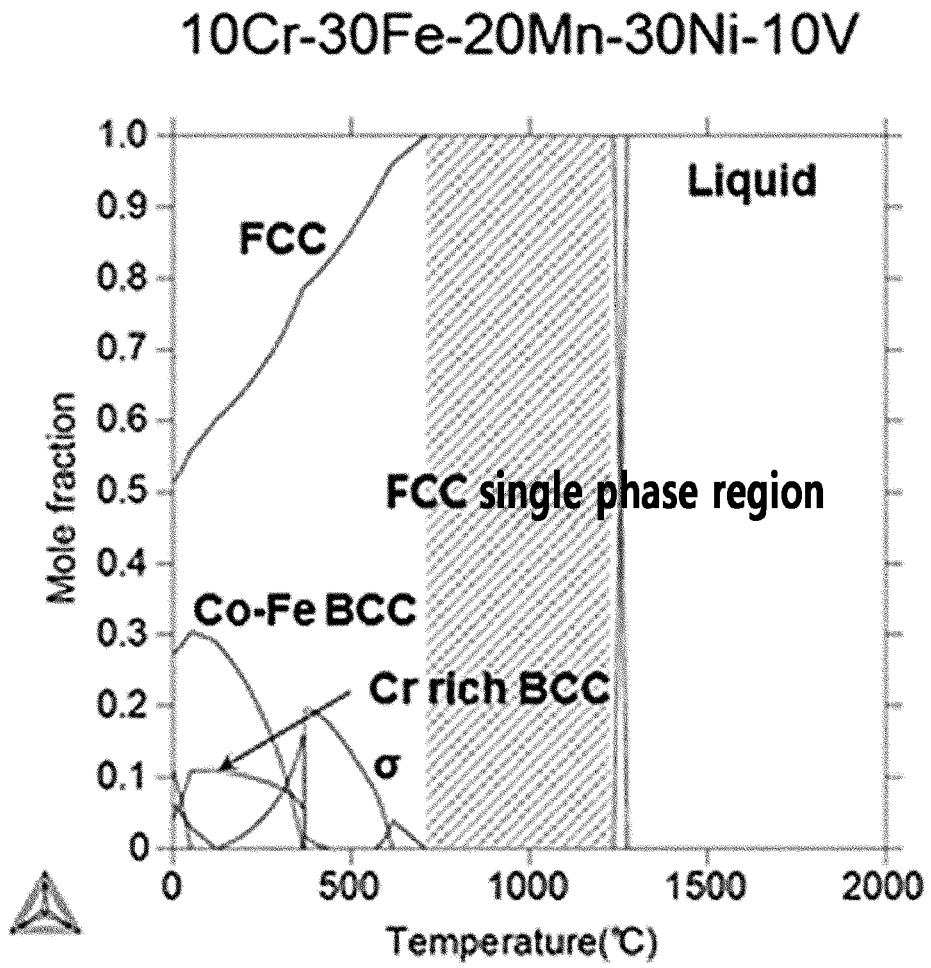

[FIG.5]
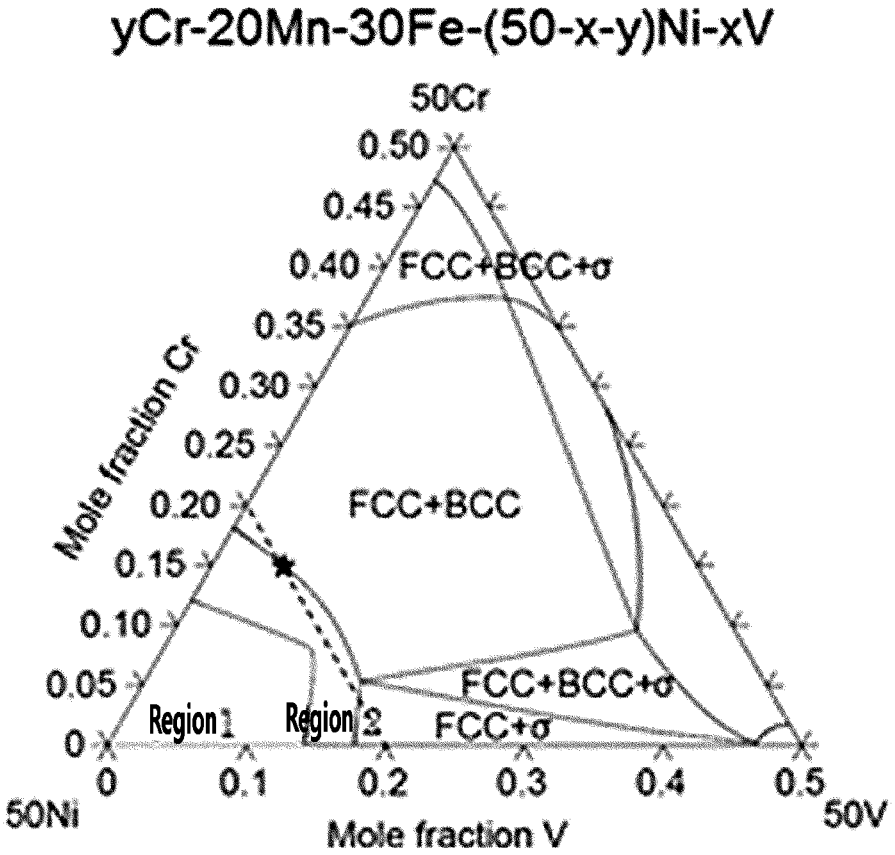

[FIG.6]
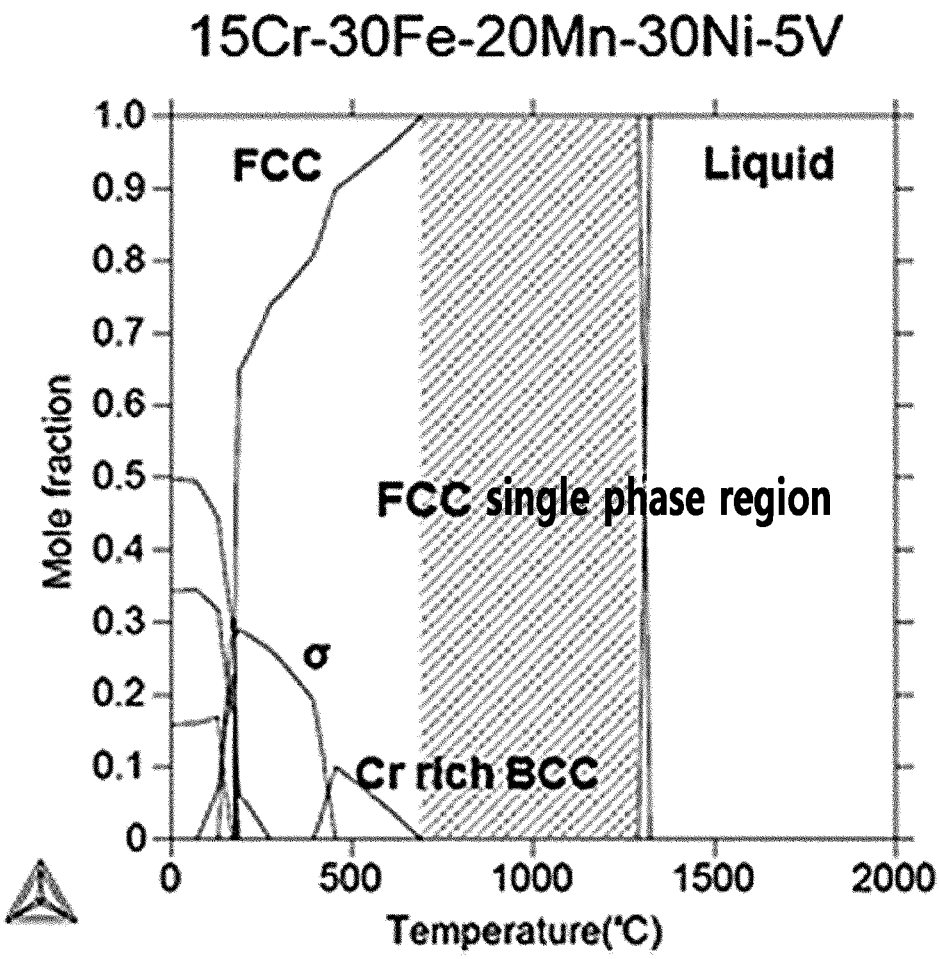

[FIG.7a]
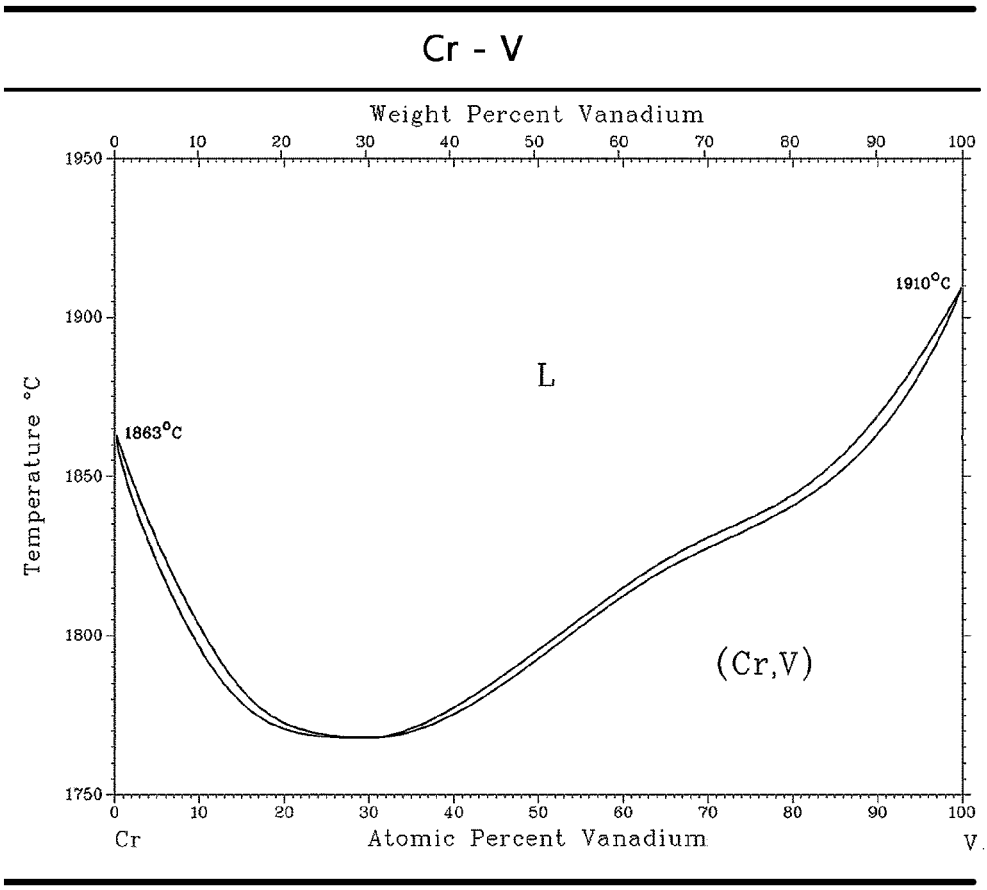

[FIG.7b]
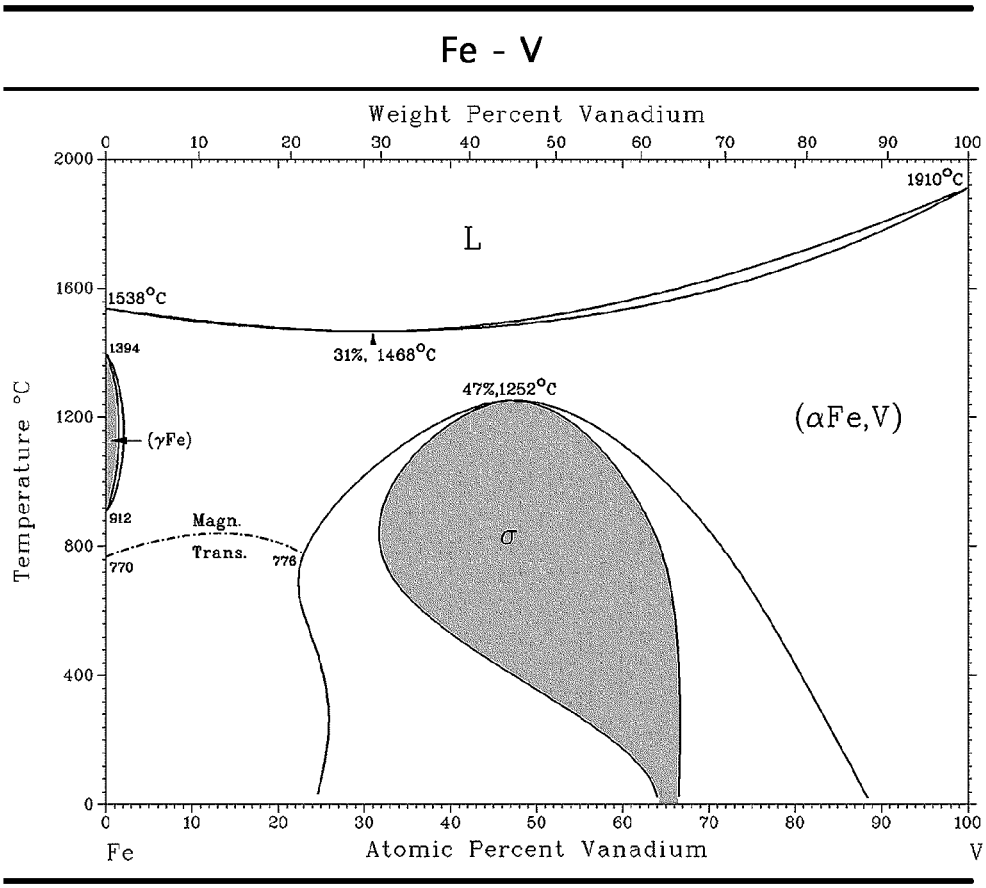

[FIG.7c]
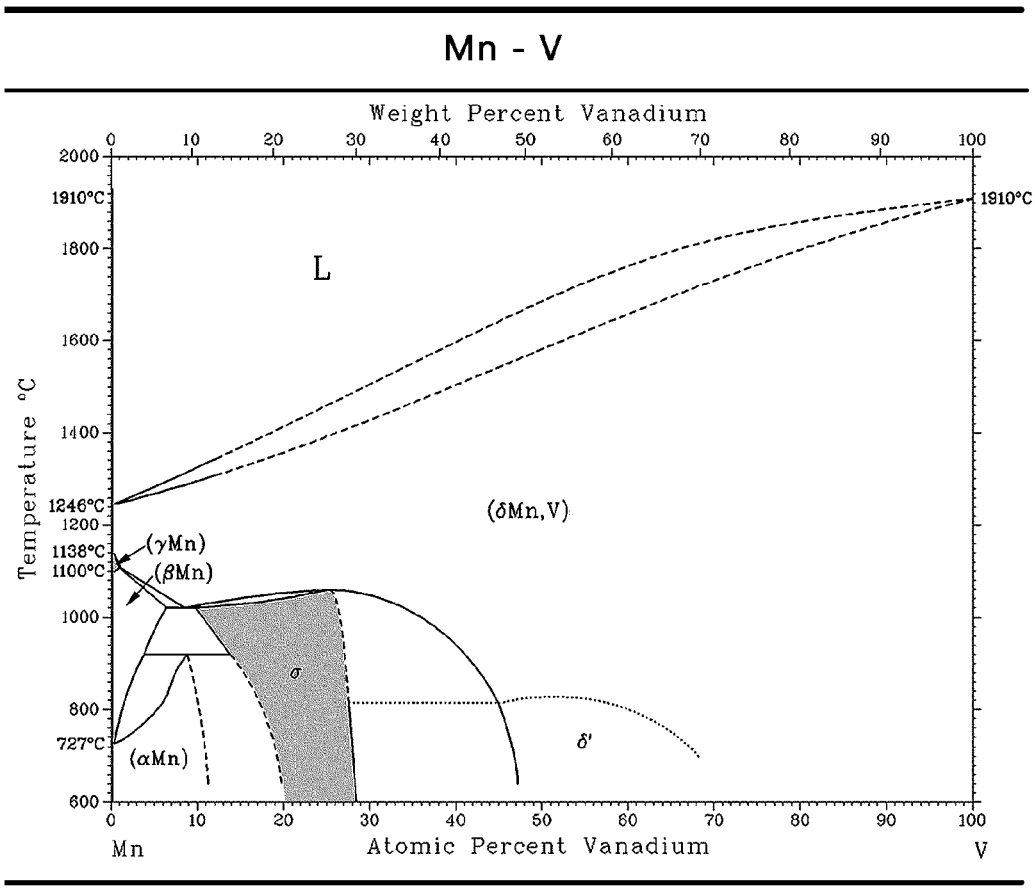

[FIG.7d]
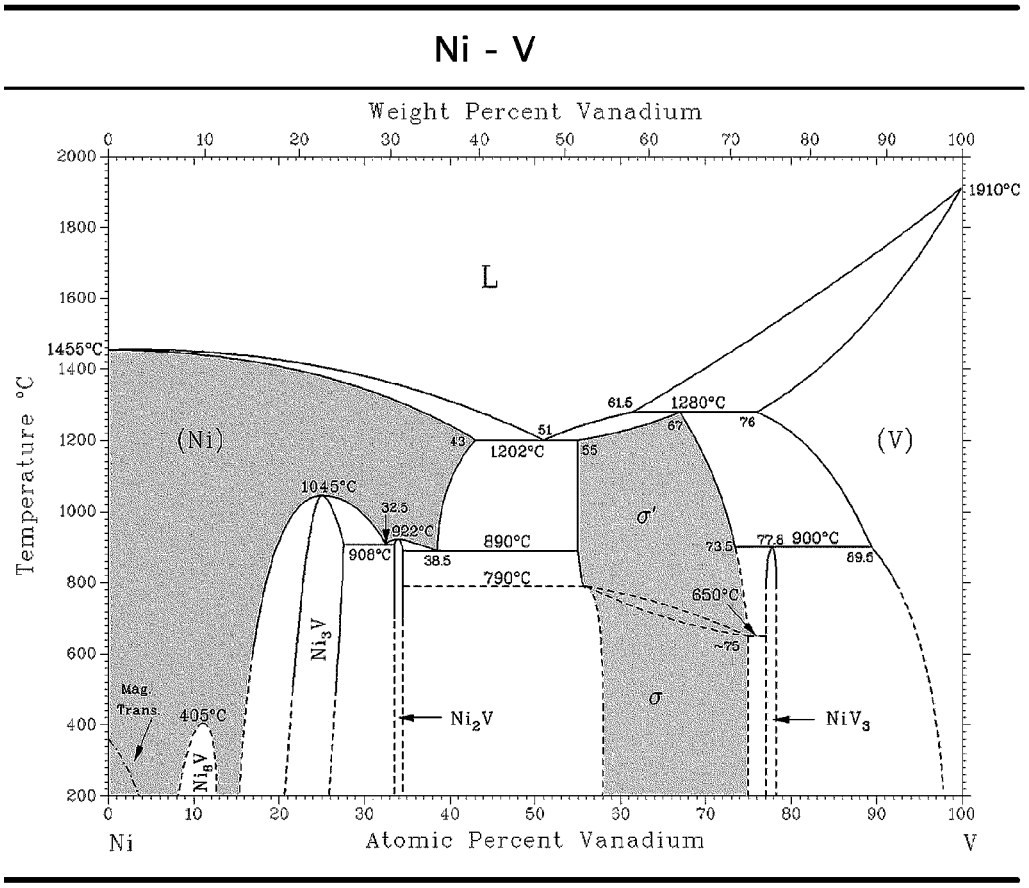

[FIG.7e]
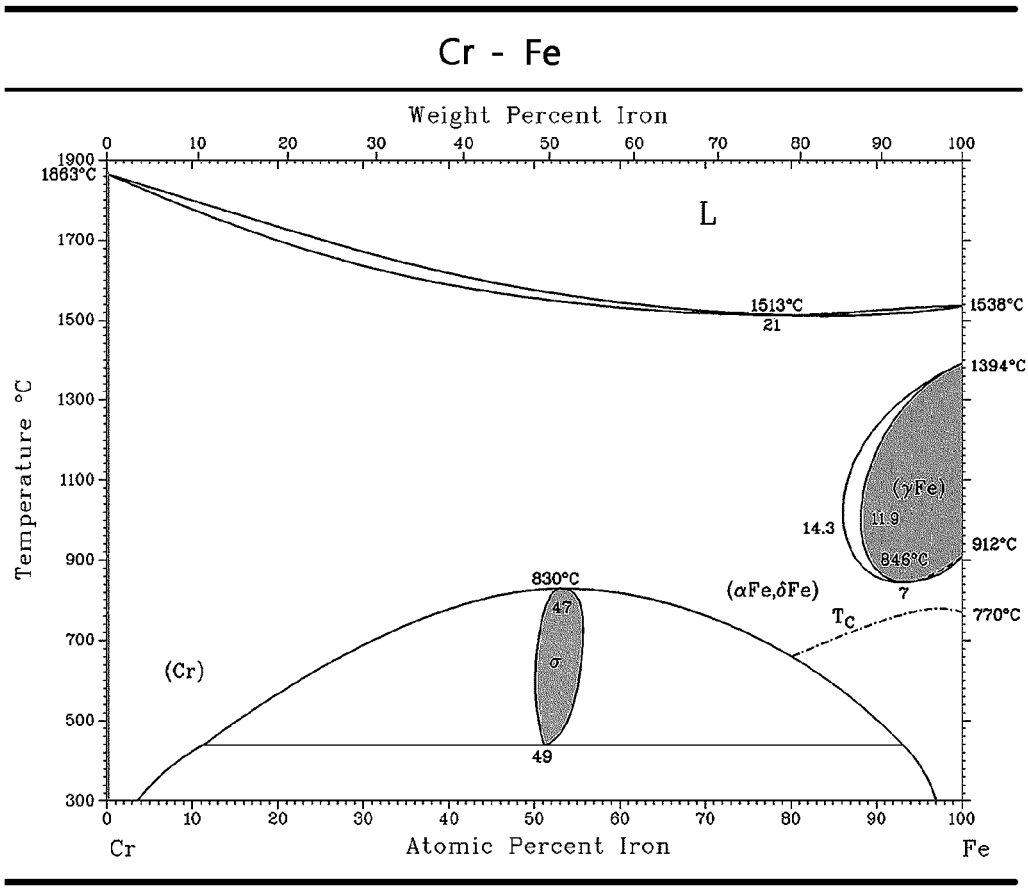

[FIG.7f]
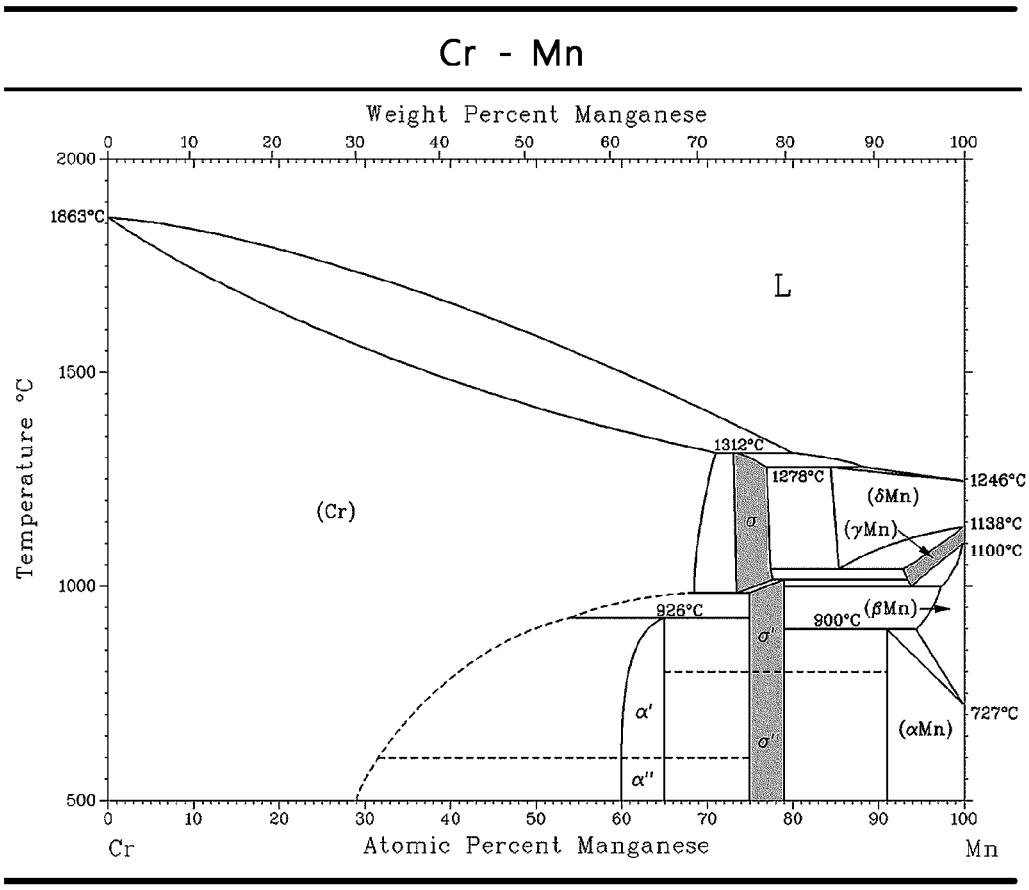

[FIG.7g]
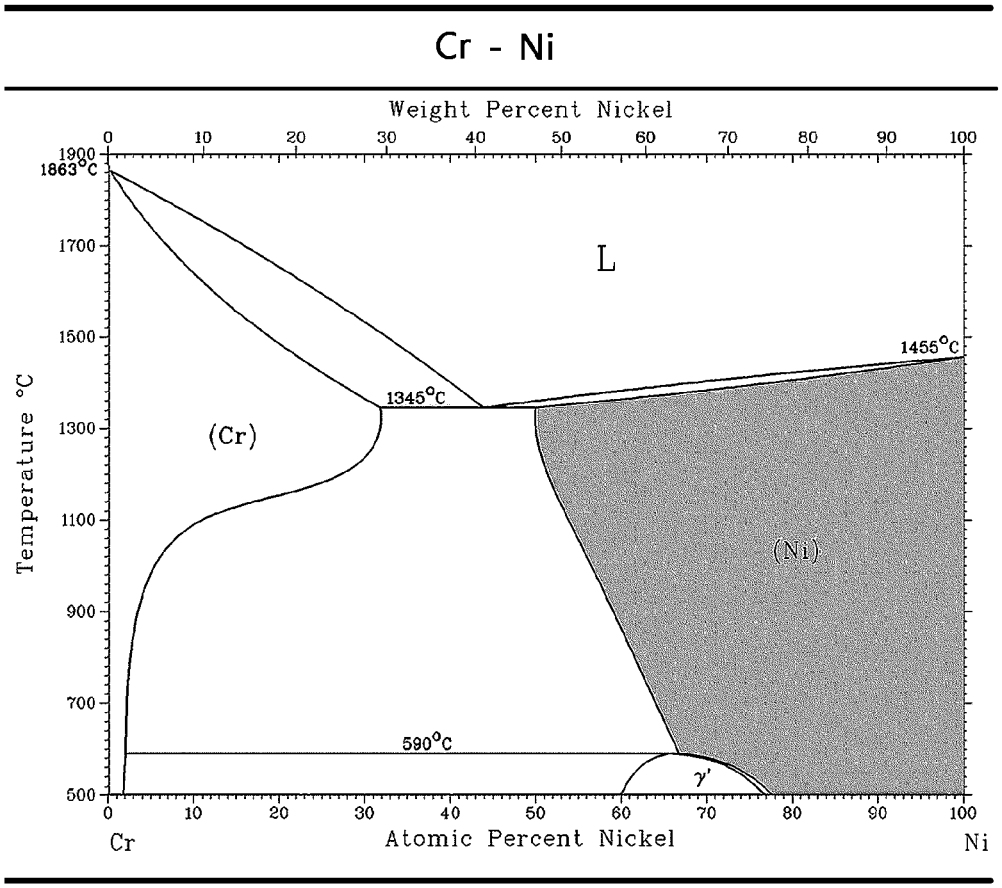

[FIG.7h]
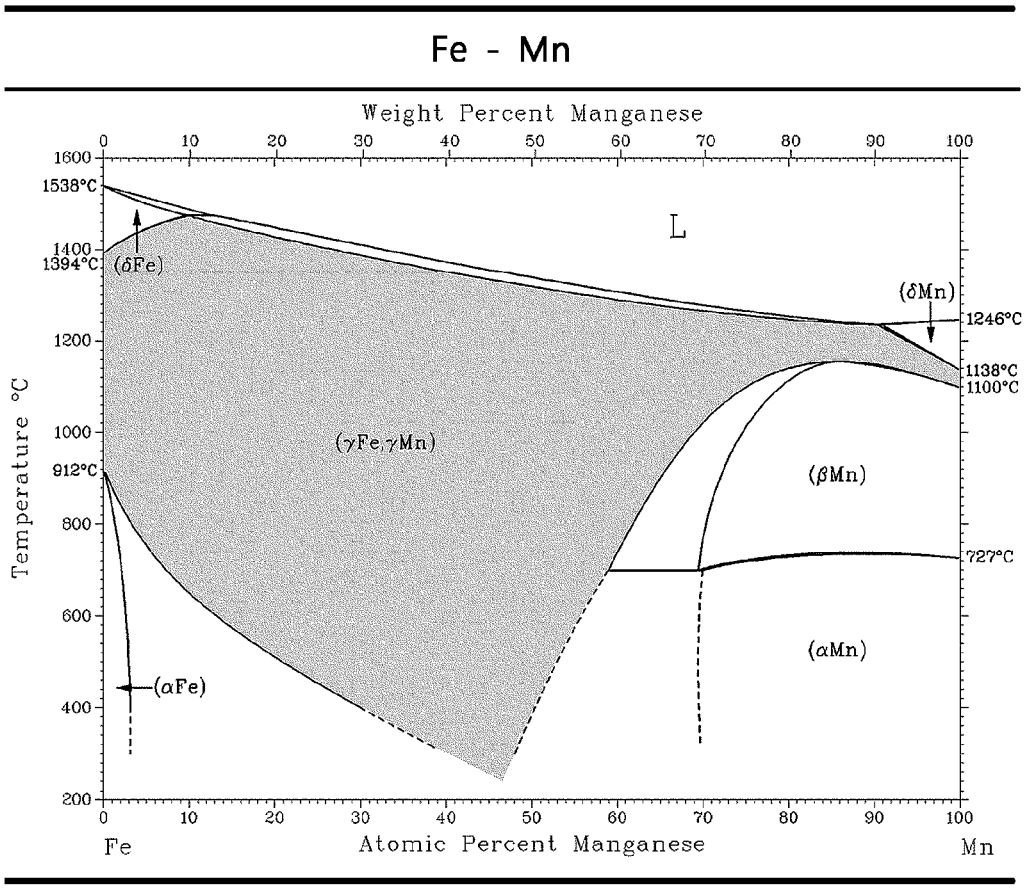

[FIG.7i]
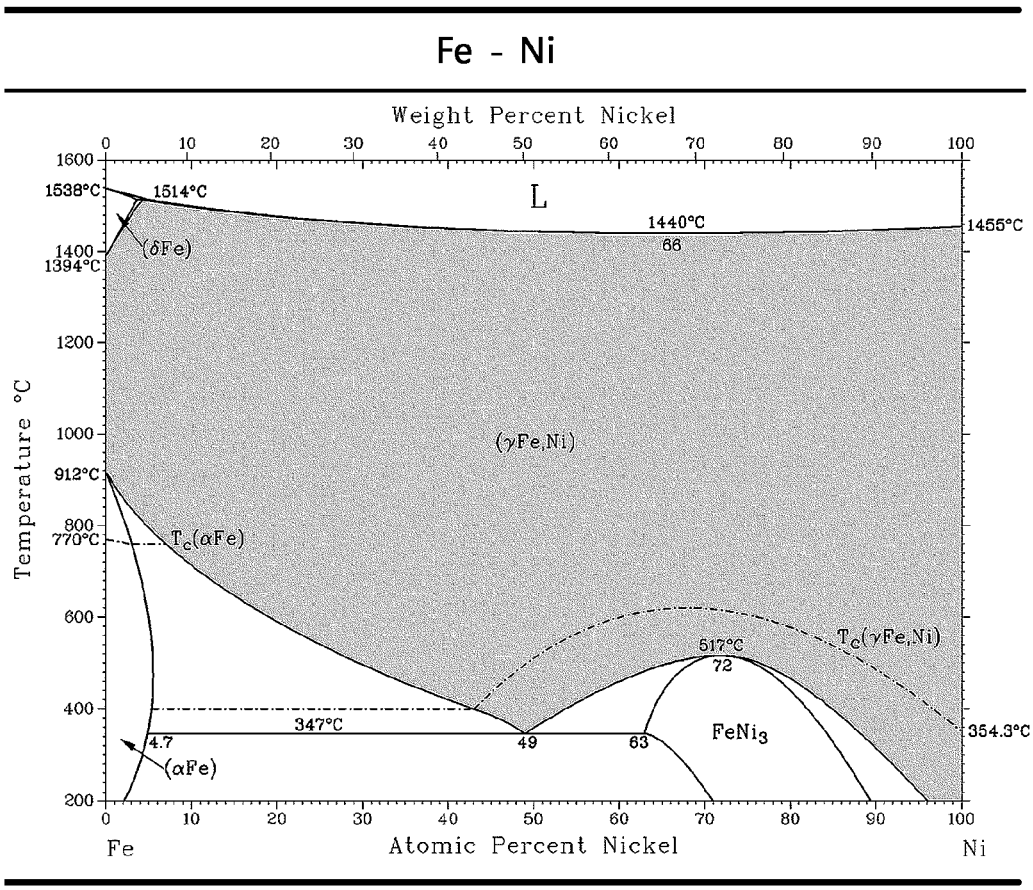

[FIG.7j]
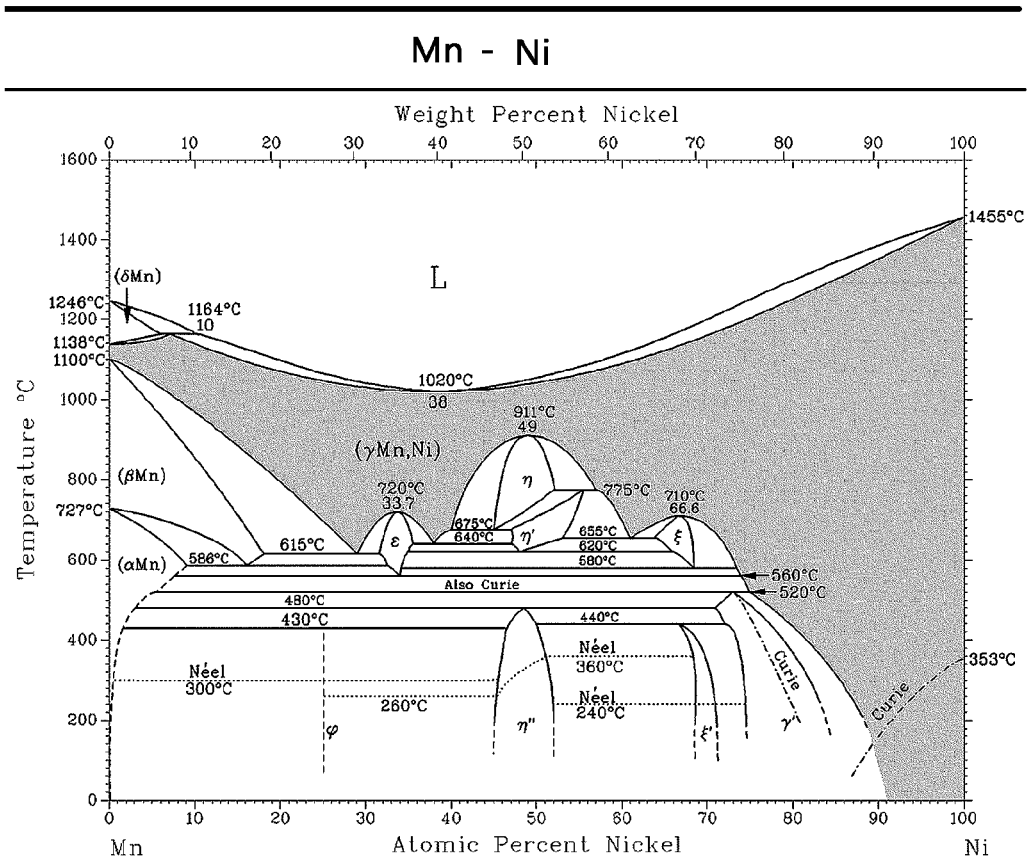

[FIG.8]
15Cr-22Fe-13Mn-40Ni-10V
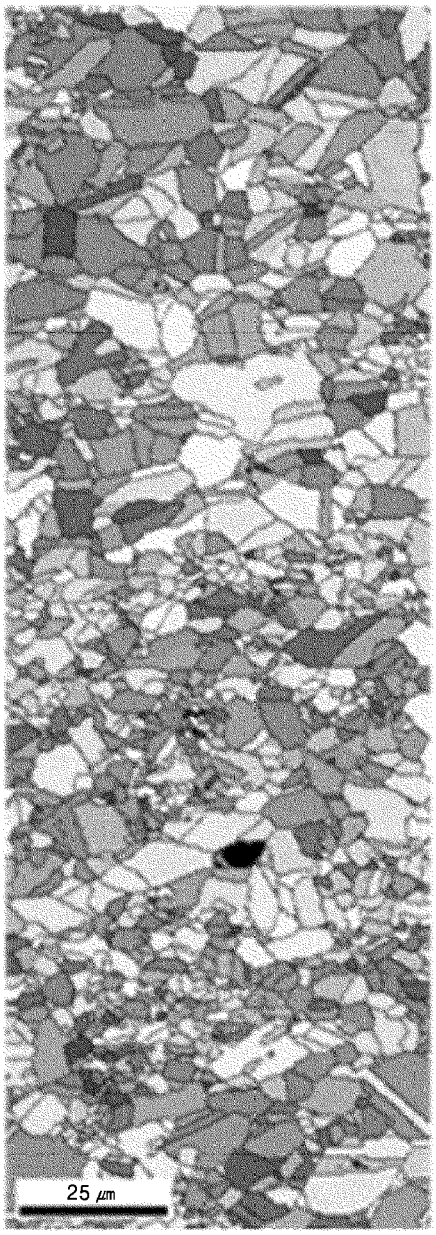
10Cr-30Fe-20Mn-30Ni-10V
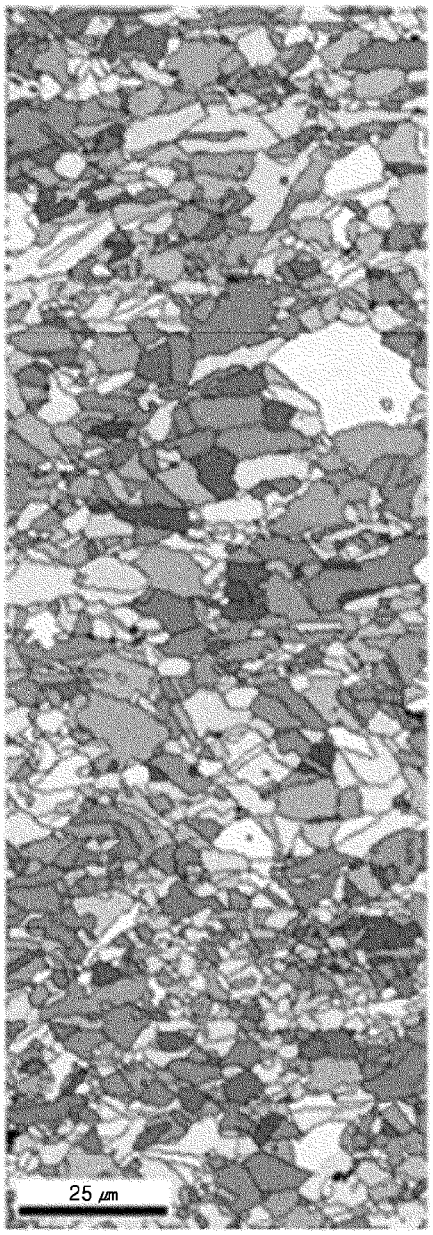

[FIG.9]
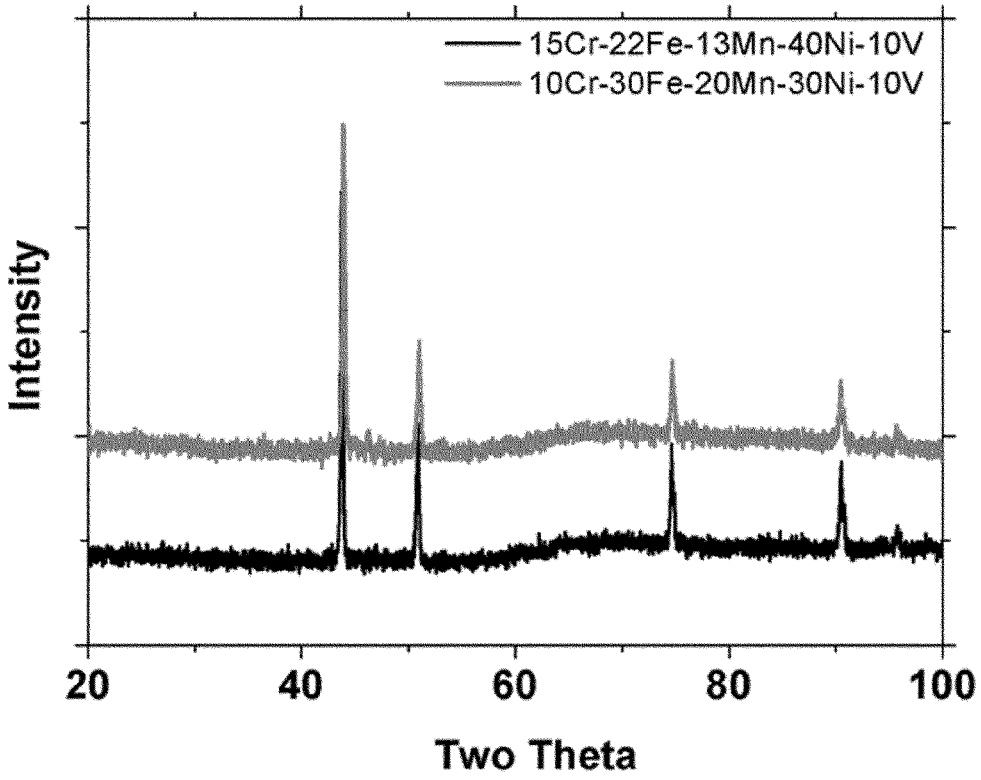

【FIG.10】
15Cr-22Fe-13Mn-40Ni-10V
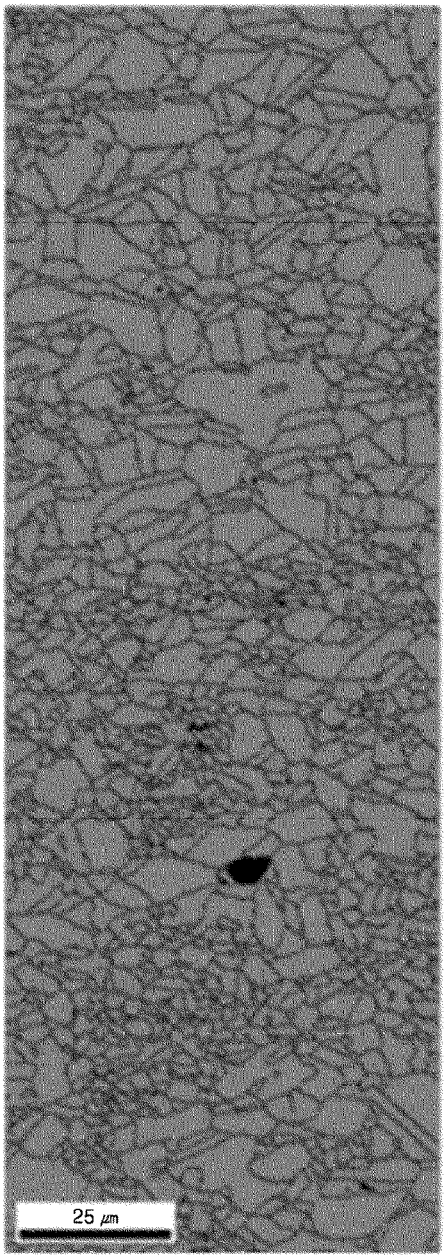
10Cr-30Fe-20Mn-30Ni-10V
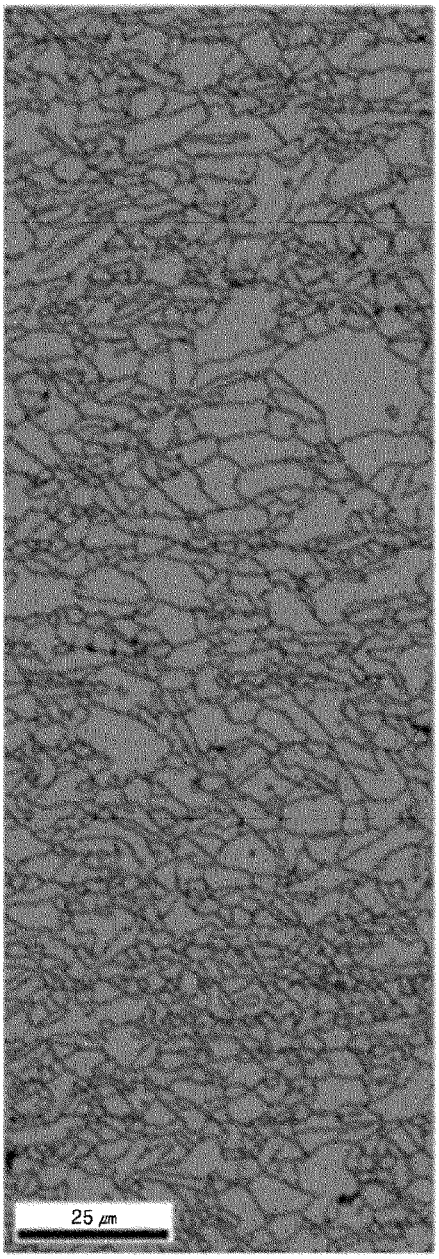

【FIG.11】
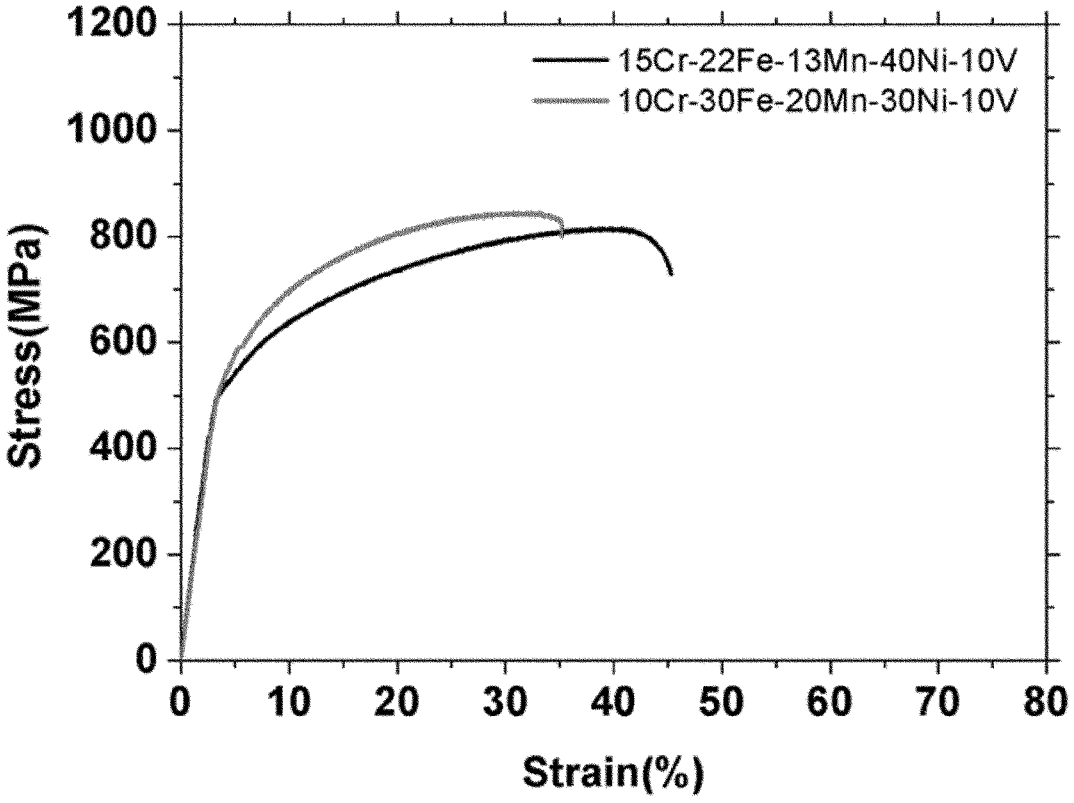

【FIG.12】
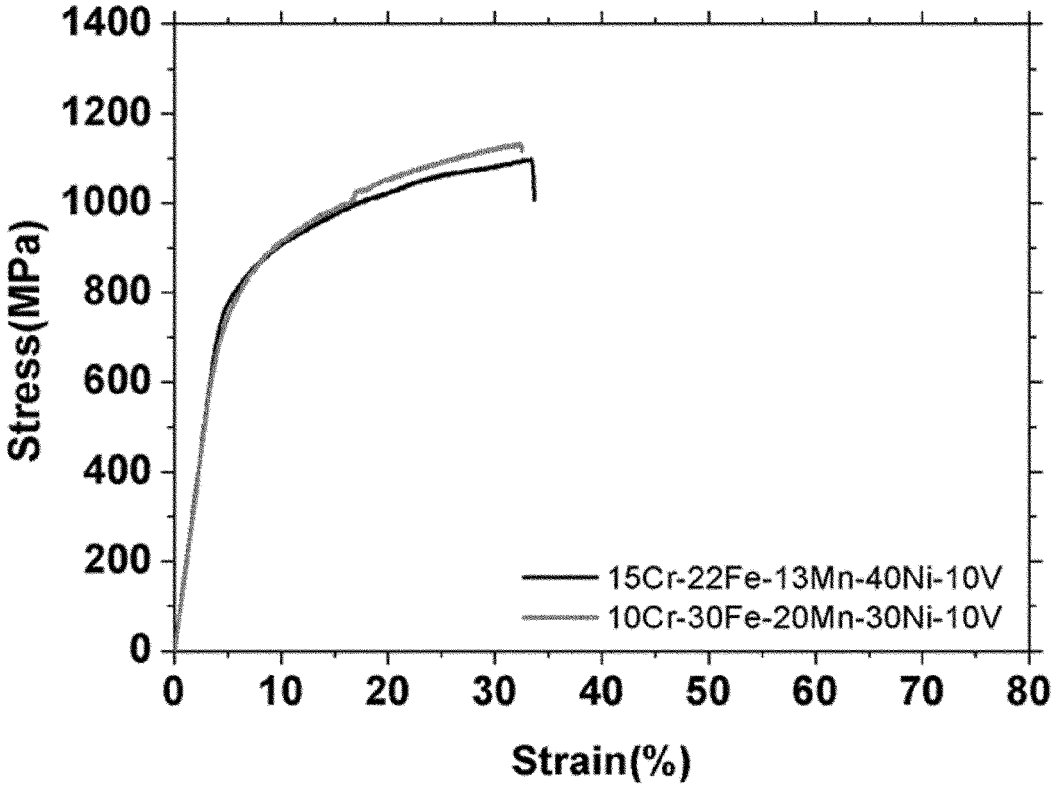

【FIG.13】
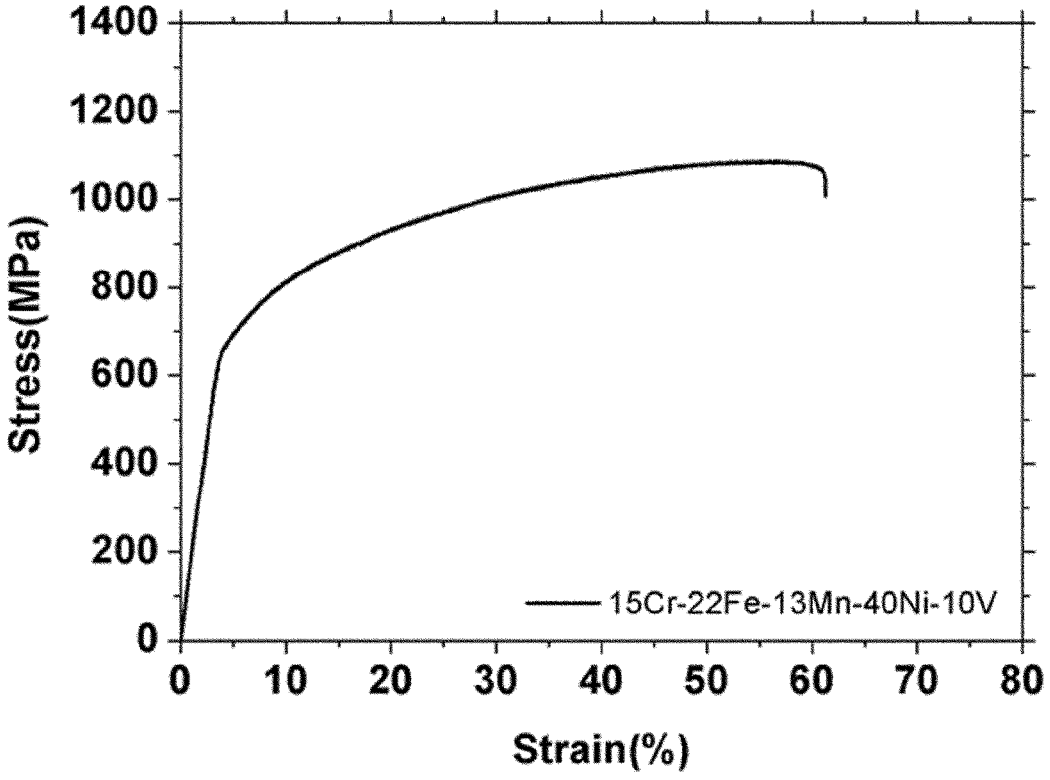

CR—FE—MN—NI—V-BASED HIGH-ENTROPY ALLOY

TECHNICAL FIELD

The present invention relates to a high-entropy alloy, which is designed using thermodynamic calculations among computational simulation techniques, and more particularly to, a Cr—Fe—Mn—Ni—V-based high-entropy alloy having excellent low temperature tensile strength and elongation by setting up an alloy composition region having a single-phase microstructure of a face centered cubic (FCC) at 700° C. or higher through thermodynamic calculations, and by allowing the FCC single-phase microstructure to be obtained at room temperature and an ultra-low temperature when quenching after heat treatment at 700° C. or higher is performed.

BACKGROUND ART

A high-entropy alloy (HEA) is a multi-element alloy composed of 5 or more elements, and is a new material of a new concept, which is composed of a face centered cubic (FCC) single phase or a body centered cubic (BCC) single phase and has excellent ductility without generating an intermetallic phase due to a high mixing entropy even through it is a high alloy system.

It has been reported in academic circles in 2004 under the name of High Entropy Alloy (HEA) that a single phase is obtained without an intermediate phase when five or more elements are alloyed with a similar ratio without a main element, and recently, there is an explosion of related research due to the sudden interest.

The reason why this particular atomic arrangement structure appears, and the characteristics thereof are not clear. However, the excellent chemical and mechanical properties of such structure have been reported, and an FCC single phase CoCrFeMnNi high-entropy alloy is reported to have a high yield and tensile strength due to the expression of a twin in a nano unit at a low temperature, and to have the highest toughness when compared with materials reported so far.

A high-entropy alloy having a face centered cubic (FCC) structure has not only excellent fracture toughness at an ultra-low temperature but also excellent corrosion resistance, and excellent mechanical properties such as high strength and high ductility, so that the development thereof as a material for an ultra-low temperature is being facilitated.

Meanwhile, Korean Patent Laid-Open Publication No. 2016-0014130 discloses a high-entropy alloy such as $Ti_{16.6}Zr_{16.6}Hf_{16.6}Ni_{16.6}Cu_{16.6}Co_{17}$, and $Ti_{16.6}Zr_{16.6}Hf_{16.6}Ni_{16.6}Cu_{16.6}Nb_{17}$ both of which can be used as a heat resistant material, and Japanese Patent Laid-Open Publication No. 2002-173732 discloses a highly-entropy alloy which has Cu—Ti—V—Fe—Ni—Zr as a main element and has high hardness and excellent corrosion resistance.

As such, various high-entropy alloys are being developed, and in order to expand the application area of high-entropy alloys, it is required to develop a high-entropy alloy having various properties while reducing manufacturing costs thereof.

DISCLOSURE OF THE INVENTION

Technical Problem

The purpose of the present invention is to provide a Cr—Fe—Mn—Ni—V-based high-entropy alloy which has an FCC single phase structure at room temperature and at an ultra-low temperature and having low temperature tensile strength and low temperature elongation properties which is capable of being suitably used at an ultra-low temperature.

Technical Solution

An aspect of the present invention to achieve the above mentioned purpose provides a high-entropy alloy including Cr: 3-18 at %, Fe: 3-60 at %, Mn: 3-40 at %, Ni: 20-80 at %, V: 3-12 at %, and unavoidable impurities, wherein the ratio of the V content to the Ni content (V/Ni) is 0.5 or less.

An alloy having such a composition is composed of a single phase of FCC without generating an intermediate phase, and exhibits more excellent tensile strength and elongation at an ultra-low temperature (77K) than at room temperature (298K).

Advantageous Effects

A new high-entropy alloy provided by the present invention has improved tensile strength and elongation at an ultra-low temperature rather than at room temperature, and therefore, is particularly useful as a structural material used in an extreme environment such as an ultra-low temperature environment.

A high-entropy alloy according to the present invention may obtain a strengthening effect more easily than an existing material by adding vanadium (V) having a different nearest neighbor atomic distance from those of other elements. In addition, by appropriately controlling the content of the other four elements according to the content of vanadium (V), the generation of a sigma phase is suppressed and an FCC single phase is implemented so that it is possible to obtain mechanical properties equal to or higher than those of a conventional high-entropy alloy without performing a strictly controlled heat treatment process.

BRIEF DESCRIPTION OF THE DRAWINGS

FIG. 1 shows phase equilibrium information at 700° C. an alloy containing 15 at % of chromium (Cr) and 10 at % of vanadium (V) according to mole fractions of iron (Fe), manganese (Mn), and nickel (Ni) which constitute the remainder of the alloy.

FIG. 2 shows change in equilibrium phase according to the temperature for an alloy having a composition represented by a star (★) in FIG. 1.

FIG. 3 shows phase equilibrium information at 700° C. according to mole fractions of remaining iron (Fe), manganese (Mn), and nickel (Ni) of an alloy containing 10 at % of chromium (Cr) and 10 at % of vanadium (V).

FIG. 4 shows change in equilibrium phase according to the temperature for an alloy having a composition represented by a star (★) in FIG. 3.

FIG. 5 shows phase equilibrium information at 700° C. of an alloy containing 30 at % of iron (Fe) and 20 at % of manganese (Mn) according to mole fractions of chromium (Cr), nickel (Ni), and vanadium (V) which constitute the remainder of the alloy.

FIG. 6 shows change in equilibrium phase according to the temperature for an alloy having a composition represented by a star (★) in FIG. 5.

FIG. 7 shows phase diagrams of binary alloy systems composed of two elements among five elements of chromium (Cr), iron (Fe), manganese (Mn), nickel (Ni), and vanadium (V).

FIG. 8 is a photograph of an EBSD inverse pole figure (IPF) map of a high entropy alloy plate material manufactured according to Example 1 and Example 3 of the present invention.

FIG. 9 shows results of an X-ray diffraction analysis of a high-entropy alloy plate material manufactured according to Example 1 and Example 3 of the present invention.

FIG. 10 is a photograph of an EBSD phase map of a high-entropy alloy plate material manufactured according to Example 1 and Example 3 of the present invention.

FIG. 11 shows results of a room temperature (298K) tensile test of a high-entropy alloy manufactured according to Example 1 and Example 3 of the present invention.

FIG. 12 shows results of an ultra-low temperature (77K) tensile test of a high-entropy alloy manufactured according to Example 1 and Example 3 of the present invention.

FIG. 13 shows results of an ultra-high temperature (77K) tensile test of a high-entropy alloy manufactured according to Example 2 of the present invention.

BEST MODE FOR CARRYING OUT THE INVENTION

Hereinafter, the configuration and the operation of embodiments of the present invention will be described with reference to the accompanying drawings. In describing the present invention, a detailed description of related known functions and configurations will be omitted when it may unnecessarily make the gist of the present invention obscure. Also, when certain portion is referred to "include" a certain element, it is understood that it may further include other elements, not excluding the other elements, unless specifically stated otherwise.

FIG. 1 shows phase equilibrium information at 700° C. of an alloy containing 15 at % of chromium (Cr) and 10 at % of vanadium (V) according to mole fractions of iron (Fe), manganese (Mn), and nickel (Ni) which constitute the remainder of the alloy.

Regions 1 and 2 of FIG. 1 represent regions in which an FCC single phase is maintained at 700° C. or lower, and the remaining regions show regions in which two-phase or three-phase equilibrium are maintained. Alloys having a composition belonging to the Region 2 of FIG. 1 maintain the FCC single phase from a melting temperature down to 700° C. or lower, to 500° C. At this time, a composition located at a boundary portion of a two-phase equilibrium region maintains the FCC single phase down to 700° C. in calculation.

A line between the Region 1 and the Region 2 is a line representing a boundary between the FCC single phase region and the two-phase equilibrium region calculated at 500° C. Alloys having a composition belonging to the Region 1 of FIG. 1 maintain the FCC single phase from a melting temperature to 500° C. or lower. A composition located at a boundary between the Region 1 and the Region 2 maintains the FCC single phase down to 500° C. in calculation.

That is, FIG. 1 means that alloys composed of 5 elements or less including 15 at % of chromium (Cr), 10 at % of vanadium (V), 0-48 at % of iron (Fe), 0-25 at % of manganese (Mn), and 27-75 at % of nickel (Ni) all maintain the FCC single phase from the melting temperature down to 700° C. or lower.

FIG. 2 shows change in equilibrium phase according to the temperature for an alloy having a composition represented by a star (★) in FIG. 1. An alloy having the composition represented by the star (★) is a composition located at a boundary between the Region 2 and the two-phase equilibrium region in FIG. 1, thereby forming an FCC single phase region from the melting temperature down to 700° C.

FIG. 3 shows phase equilibrium information at 700° C. of an alloy containing 10 at % of chromium (Cr) and 10 at % of vanadium (V) according to mole fractions of iron (Fe), manganese (Mn), and nickel (Ni) which constitute the remainder of the alloy.

FIG. 3 means that alloys composed of 5 elements or less including 10 at % of chromium (Cr), 10 at % of vanadium (V), 0-56 at % of iron (Fe), 0-41 at % of manganese (Mn), and 23-80 at % of nickel (Ni) all maintain the FCC single phase from the melting temperature down to 700° C. or lower.

FIG. 4 shows change in equilibrium phase according to the temperature for an alloy having a composition represented by a star (★) in FIG. 3.

FIG. 5 shows phase equilibrium information at 700° C. of an alloy containing 30 at % of iron (Fe) and 20 at % of manganese (Mn) according to mole fractions of chromium (Cr), nickel (Ni), and vanadium (V) which constitute the remainder of the alloy.

FIG. 5 means that alloys composed of 5 elements or less including 30 at % of iron (Fe), 20 at % of manganese (Mn), 0~18 at % of chromium (Cr), 28-50 at % of nickel (Ni), 0-18 at % of vanadium (V) all maintain the FCC single phase from the melting temperature down to 700° C. or lower.

FIG. 6 shows change in equilibrium phase according to the temperature for an alloy having a composition represented by a star (★) in FIG. 5.

FIG. 7 shows phase diagrams of binary alloy systems composed of two elements among five elements of chromium (Cr), iron (Fe), manganese (Mn), nickel (Ni), and vanadium (V).

In FIG. 7, the FCC single-phase region and the sigma phase region which deteriorates mechanical properties are displayed in dark color. Six binary alloy systems not including vanadium (V) have a small sigma phase region and a widely distributed FCC single phase region. On the other hand, four binary alloy systems including vanadium (V) have a relatively wide sigma phase region. Particularly, in the cases of a nickel (Ni)-vanadium (V) binary alloy system, the sigma phase region is distributed to a high temperature at which a liquid phase is stable. However, in the nickel (Ni)-vanadium (V) alloy system phase diagram, the sigma phase mainly appears in a section in which the ratio of vanadium (V) content to nickel (Ni) content (V/Ni) is high, and a wide FCC single phase appears in a section in which the ratio of vanadium (V) content to nickel (Ni) content (V/Ni) is low.

FIG. 7 means that if the ratio of V content to Ni content (V/Ni) is lowered, it is possible to design a high-entropy alloy composed of the FCC single phase.

From the thermodynamic information shown in FIG. 1, FIG. 3, FIG. 5 and FIG. 7, inventors of the present invention have derived a high-entropy alloy composed of an FCC single phase and having excellent low temperature properties, the alloy including 3-18 at % of Cr, 3-60 at % of Fe, 3-40 at % of Mn, 20-80 at % of Ni, 3-12 at % of V, and unavoidable impurities, wherein the ratio of the V content to the Ni content (V/Ni) is 0.5 or less.

When the content of Cr is less than 3 at %, it is disadvantageous to mechanical properties of an alloy such as corrosion resistance, and when the content of Cr is greater than 18 at %, the possibility an intermediate phase being generated is increased. Therefore, the content of the Cr is preferably 3-18 at %. When phase stability and mechanical properties are considered, the content of the Cr is more preferably 7-18 at %.

When the content of Fe is less than 3 at %, it is disadvantageous to manufacturing costs, and when the content of Fe is greater than 60 at %, the phase becomes unstable. Therefore, the content of the Fe is preferably 3-60 at %. When phase stability and mechanical properties are considered, the content of the Fe is more preferably 18-35 at %.

When the content of Mn is less than 3 at %, it is disadvantageous to manufacturing costs, and when the content of Mn is greater than 40 at %, the phase becomes unstable and there is a possibility of an oxide is formed during a manufacturing process. Therefore, the content of the Mn is preferably 3-40 at %. When phase stability and mechanical properties are considered, the content of the Mn is more preferably 10-25 at %.

When the content of Ni is less than 20 at %, the phase becomes unstable, and when the content of Ni is greater than 80 at %, it is disadvantageous to manufacturing costs. Therefore, the content of the Ni is preferably 20-80 at %. When phase stability and mechanical properties are considered, the content of the Ni is more preferably 25-45 at %.

When the content of V is less than 3 at %, it is difficult to obtain a strengthening effect and when the content of V is greater than 12 at %, the possibility of an intermediate phase being generated is increased. Therefore, the content of the V is 3-12 atom % is preferable. When phase stability, mechanical properties, and manufacturing costs are considered, the content of the V is more preferably 5-12 at %.

In addition, in order to stably implement an FCC single phase structure, it is preferable that the ratio of the V content to the Ni content (V/Ni) is 0.5 or less.

It is preferable to maintain the composition ranges of an alloy since it becomes difficult to obtain a solid solution having an FCC single phase when the composition ranges deviate from respective composition constituting the alloy.

In addition, in the high-entropy alloy, when the content of Ni is 30 at % or greater, optimal properties are exhibited. Therefore, it is preferable that the sum of the Fe and the Mn is 50 at % or less.

In addition, in the aspect of obtaining a high-entropy alloy having excellent mechanical properties and stability, it is more preferable that the composition of each component constituting the high-entropy alloy is 7-18 at % of Cr, 18-35 at % of Fe, 10-25 at % of Mn, 25-45 at % of Ni, 5-12 at % of V, wherein the ratio of the V content to the Ni content (V/Ni) is 0.5 or less.

In addition, the high-entropy alloy may have tensile strength of 1000 MPa or greater and elongation of 30% or greater at an ultra-low temperature (77K).

In addition, the high-entropy alloy may have tensile strength of 1000 MPa or greater and elongation of 60% or greater at an ultra-low temperature (77K).

In addition, the high-entropy alloy may have tensile strength of 800 MPa or greater and elongation of 30% or greater at room temperature (298K).

Hereinafter, the present invention will be described in more detail based on preferred embodiments of the present invention, but the present invention should not be construed as being limited to the preferred embodiments of the present invention.

EXAMPLE 1

Manufacturing a High-Entropy Alloy

Table 1 below shows three compositions selected for manufacturing an alloy of a region calculated through the thermodynamic review described above.

TABLE 1

| Alloy | Ingot composition (at %) | | | | |
|---|---|---|---|---|---|
| No. | Cr | Fe | Mn | Ni | V |
| 1 | 15 | 22 | 13 | 40 | 10 |
| 2 | 10 | 30 | 20 | 30 | 10 |
| 3 | 15 | 30 | 20 | 30 | 5 |

Cr, Fe, Mn, Ni, and V of 99.9% or greater of high purity were prepared so as to have the composition shown in Table 1, and an alloy was melted at a temperature of 1500° C. or higher using a vacuum induction melting furnace to prepare an ingot by a known method.

EXAMPLE 1

No. 1 alloy ingot was maintained in an FCC single phase region at 1000° C. for 2 hours to homogenize the structure thereof, and then the homogenized ingot was pickled to remove impurities and an oxide layer on the surface thereof.

The pickled ingot was cold-rolled at a reduction ratio of 75% to produce a cold rolled-plate.

The cold-rolled plate as such was subjected to heat treatment (800° C., 2 hours) in the FCC single phase region to remove residual stress, and crystal grains were completely recrystallized and then water-cooled to manufacture a high-entropy alloy plate material.

EXAMPLE 2

No. 1 alloy ingot was maintained in an FCC single phase region at 1100° C. for 6 hours to homogenize the structure thereof, and then the homogenized ingot was pickled to remove impurities and an oxide layer on the surface thereof.

The pickled ingot was cold-rolled at a reduction ratio of 75% to produce a cold rolled-plate.

Thereafter, the cold-rolled plate was subjected to heat treatment (800° C., 2 hours) in the FCC single phase region to remove residual stress, and crystal grains were completely recrystallized and then water-cooled to manufacture a high-entropy alloy plate material.

That is, the high-entropy alloy plate material manufactured according to Example 2 has the same composition as in Example 1 except that only heat treatment conditions are different.

EXAMPLE 3

No. 2 alloy ingot was manufactured into a high-entropy alloy plate material through the same manufacturing process as in Example 1.

No. 3 alloy ingot of Table 1 above was not manufactured into a high-entropy alloy plate material to evaluate microstructure and mechanical properties thereof. However, as shown in FIG. 6, it can be seen that it is a composition capable of generating an FCC single phase at room temperature (298K) and at an ultra-low temperature (77K) when quenching after heat treatment in the FCC single phase region (800° C. or higher) is performed.

Microstructure

The microstructure of a high-entropy alloy manufactured as described above was analyzed using a scanning electron microscope, an X-ray diffraction analyzer, and an EBSD.

FIG. 8 is a photograph of an EBSD inverse pole figure (IPF) map of a high-entropy alloy manufactured according to Example 1 and Example 3.

It is possible to measure the size of the crystal grains from the map, and the two alloys which were subjected to cold rolling at the reduction ratio of 75% and recrystallization heat treatment have a mean crystal grain size of 5.4-7.4 μm. Crystal phases have a polycrystalline shape, and the size thereof is relatively uniform regardless of the composition of the alloy.

FIG. 9 shows results of an X-ray diffraction analysis of a high-entropy alloy plate manufactured according to Example 1 and Example 3 of the present invention. The two alloys exhibit the same peak, and according to the analysis result thereof, it was confirmed that the peak corresponds to an FCC structure.

FIG. 10 is a photograph of an EBSD phase map of a high-entropy alloy plate material manufactured according to Example 1 and Example 3. The EBSD phase map displays each phase in different colors when two or more different phases are in the microstructure. As confirmed in FIG. 10, alloys according to Example 1 and Example 3 are all represented in the same single color, which means that the microstructure of the alloys is composed of an FCC single phase, and a second phase such as a sigma phase which deteriorates mechanical properties is not generated.

Evaluation of Mechanical Properties at Room Temperature and at an Ultra-Low Temperature Tensile properties of a high-entropy alloy plate material manufactured as described above were evaluated at room temperature (298K) through a tensile tester. FIG. 11 and Table 2 show the results.

TABLE 2

| | Room temperature (298 K) | | |
|---|---|---|---|
| | YS (MPa) | UTS (MPa) | El. (%) |
| Example 1 | 460 | 815 | 45.2 |
| Example 2 | 503 | 842 | 35.2 |

As shown in Table 2, the high-entropy alloy plate materials according to Example 1 and Example 3 of the present invention exhibit excellent tensile properties at room temperature (298K) having a yield strength of 460-503 MPa, tensile strength of 815-842 MPa, and elongation of 35-45%.

FIGS. 12 and 13, and Table 3 below show results of evaluating tensile properties at an ultra-low temperature (77K) using an ultra-low temperature chamber and a tensile tester.

The invention claimed is:

1. A high-entropy alloy consisting of: Cr: 3-18 at%; Fe: 3-60 at%; Mn: 3-40 at%; Ni: 20-80 at%; V: 3-12 at%; and unavoidable impurities, wherein the ratio of the V content to the Ni content (V/Ni) is 0.5 or less, and the alloy is a single phase of a face centered cubic structure.

2. The high-entropy alloy of claim 1, wherein the sum of the Fe content and the Mn content is less than 50 at%.

3. The high-entropy alloy of claim 1, wherein the alloy has tensile strength of 1000 MPa or greater and elongation of 30% or greater at an ultra-low temperature (77K).

4. The high-entropy alloy of claim 1, wherein the alloy has tensile strength of 1000 MPa or greater and elongation of 60% or greater at an ultra-low temperature (77K).

5. The high-entropy alloy of claim 1, wherein the alloy has tensile strength of 800 MPa or greater and elongation of 30% or greater at room temperature (298K).

* * * * *